US008407923B2

(12) United States Patent
Ash, Jr. et al.

(10) Patent No.: US 8,407,923 B2
(45) Date of Patent: Apr. 2, 2013

(54) SYSTEMS AND METHODS FOR ASSOCIATING AN ACCESSORY WITH A FIREARM

(75) Inventors: Gerald B. Ash, Jr., Newington, GA (US); Eric M. Rice, Rincon, GA (US)

(73) Assignee: Daniel Defense, Inc., Black Creek, GA (US)

( * ) Notice: Subject to any disclaimer, the term of this patent is extended or adjusted under 35 U.S.C. 154(b) by 156 days.

(21) Appl. No.: 12/724,074

(22) Filed: Mar. 15, 2010

(65) Prior Publication Data

US 2011/0219657 A1 Sep. 15, 2011

(51) Int. Cl.
*F41C 27/00* (2006.01)
*B23P 11/00* (2006.01)

(52) U.S. Cl. ..... 42/90; 29/525.01

(58) Field of Classification Search ..... 42/85, 90, 42/96, 97, 98, 106, 124, 127; 29/428, 525.01; 24/2.5, 542

See application file for complete search history.

(56) References Cited

U.S. PATENT DOCUMENTS

| | | | | |
|---|---|---|---|---|
| 3,405,448 | A * | 10/1968 | Weatherby | 42/127 |
| 5,155,915 | A * | 10/1992 | Repa | 42/127 |
| D394,096 | S * | 5/1998 | Edgar | D22/110 |
| 6,637,144 | B2 * | 10/2003 | Nelson et al. | 42/120 |
| 6,922,934 | B1 * | 8/2005 | Huan | 42/127 |
| 6,931,778 | B1 * | 8/2005 | Nelson et al. | 42/120 |
| 7,273,292 | B2 * | 9/2007 | Kim | 362/112 |

* cited by examiner

*Primary Examiner* — Bret Hayes
(74) *Attorney, Agent, or Firm* — Sutherland Asbill & Brennan LLP

(57) ABSTRACT

Systems and methods for associating an accessory with a firearm include, in one embodiment, an accessory having an accessory portion and an attachment portion. The accessory portion is associated with any accessory a user may desire to associate with the firearm. The attachment portion allows the accessory to be associated with a rail assembly of the firearm. The attachment portion includes a first mounting arm and a second mounting arm configured to be positioned about the rail assembly when the accessory is snapped about the rail assembly. Also included is a securing mechanism for limiting the movement of the accessory when the accessory is snapped about the rail assembly.

16 Claims, 6 Drawing Sheets

SYSTEMS AND METHODS FOR ASSOCIATING AN ACCESSORY WITH A FIREARM

TECHNICAL FIELD

The present disclosure generally relates to firearms, and more particularly relates to systems and methods for associating an accessory with a firearm.

BACKGROUND OF THE INVENTION

Firearms, such as M-16, AR-15 rifles, AR-10 rifles, and M-4 rifles, are often used with accessories, such as scopes, lasers, grenade launchers, and the like. Such accessories can be associated with the firearm by attaching either directly or indirectly to the firearm. Indirect attachment can be associated with the use of one or more adapters, such as a throw lever or other mechanism, that attaches to a portion of the firearm and can receive a portion of the accessory when mounting the accessory to the firearm. Direct attachment, in contrast, can be associated with attaching an accessory to a portion of the firearm, such as a rail, rather than through one or more adapters.

A firearm comprising a rail may include a rail having a number of mounting projections interleaved with a series of grooves. Rails are known in the firearm industry and usually conform to standards defined by, for example, the U.S. government. Two common rails include the "Picatinny" rail and the "Weaver" rail that, although differing in dimension, include interleaved mounting projections and grooves. These mounting projections and grooves located along the rail may be employed to associate the accessory with the rail. For example, some accessories may be associated with the rail by sliding onto one end of the rail and, after being positioned appropriately along the rail, by securing the accessory against the rail. Other accessories can be positioned along the rail, placed around the rail, and then secured to the rail. In both instances, associating the accessory with the firearm can be relatively cumbersome and time consuming.

When sliding an accessory onto one end of a rail, a user often encounters difficulty mating the accessory against the rail and then sliding the accessory along the rail to obtain a desired position. In some instances, this difficulty can be associated with mating the profile of the rail with a corresponding profile of the accessory. In other instances, this difficulty can be associated with friction encountered from sliding the accessory along the rail. This friction can be further aggravated by improper alignment of the accessory with the rail or by inadvertent engagement of the accessory with the rail assembly's interleaved projections and grooves.

Similarly, securing an accessory to the rail without first engaging the rail can be a cumbersome endeavor in part because a user must employ both hands—one hand to position and hold the accessory into place and another hand to secure the accessory to the rail. Thus, the user's ability to operate and/or hold the firearm can be compromised since both hands must be employed to manipulate the accessory. In addition, associating an accessory with the firearm in this way can require a user to reposition the accessory multiple times since the position of the accessory relative to the user's operational posture can not be evaluated until the accessory has been secured to the rail.

SUMMARY OF THE INVENTION

Embodiments of the invention can include systems and methods for associating an accessory with a firearm. In certain embodiments, an accessory having an accessory portion and an attachment portion can be provided. The attachment portion can allow the accessory to be associated with a rail assembly of the firearm, such as when the accessory is snapped about the rail assembly. The attachment portion can include one or more first mounting arms and one or more second mounting arms that are configured to be positioned about the rail assembly when the accessory is snapped about the rail assembly. The accessory can also include a securing mechanism for limiting the movement of the accessory on the rail, such as along the length of rail assembly when the accessory is snapped about the rail assembly.

In other embodiments, a method for associating an accessory with a firearm can be provided. The method can include positioning one or more first mounting arms about a first portion of a rail assembly of the firearm. The method can also include rotating the accessory about a longitudinal axis of the rail assembly until one or more second mounting arms abut a second portion of the rail assembly. The method can also include pressing the accessory against the rail assembly from a direction that is substantially transverse to the longitudinal axis of the rail assembly until the one or more second mounting arms are displaced in relation to the one or more first mounting arms and positioned about the second portion of the rail assembly.

In other embodiments, a system for associating an accessory with a firearm can be provided. The system can include one or more first mounting arms and one or more second mounting arms spaced apart from the one or more first mounting arms to position about a portion of the rail assembly when the accessory is snapped about the rail assembly. The system can also include a securing mechanism configured to limit movement of the accessory along the length of rail assembly when the accessory is snapped about the rail assembly.

Other systems, devices, methods, and features of the disclosed systems, methods, and apparatuses will be apparent or will become apparent to one with skill in the art upon examination of the following figures and detailed description. All such additional systems, devices, methods, and features are intended to be included within the description and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION OF THE INVENTION

Figure 1:
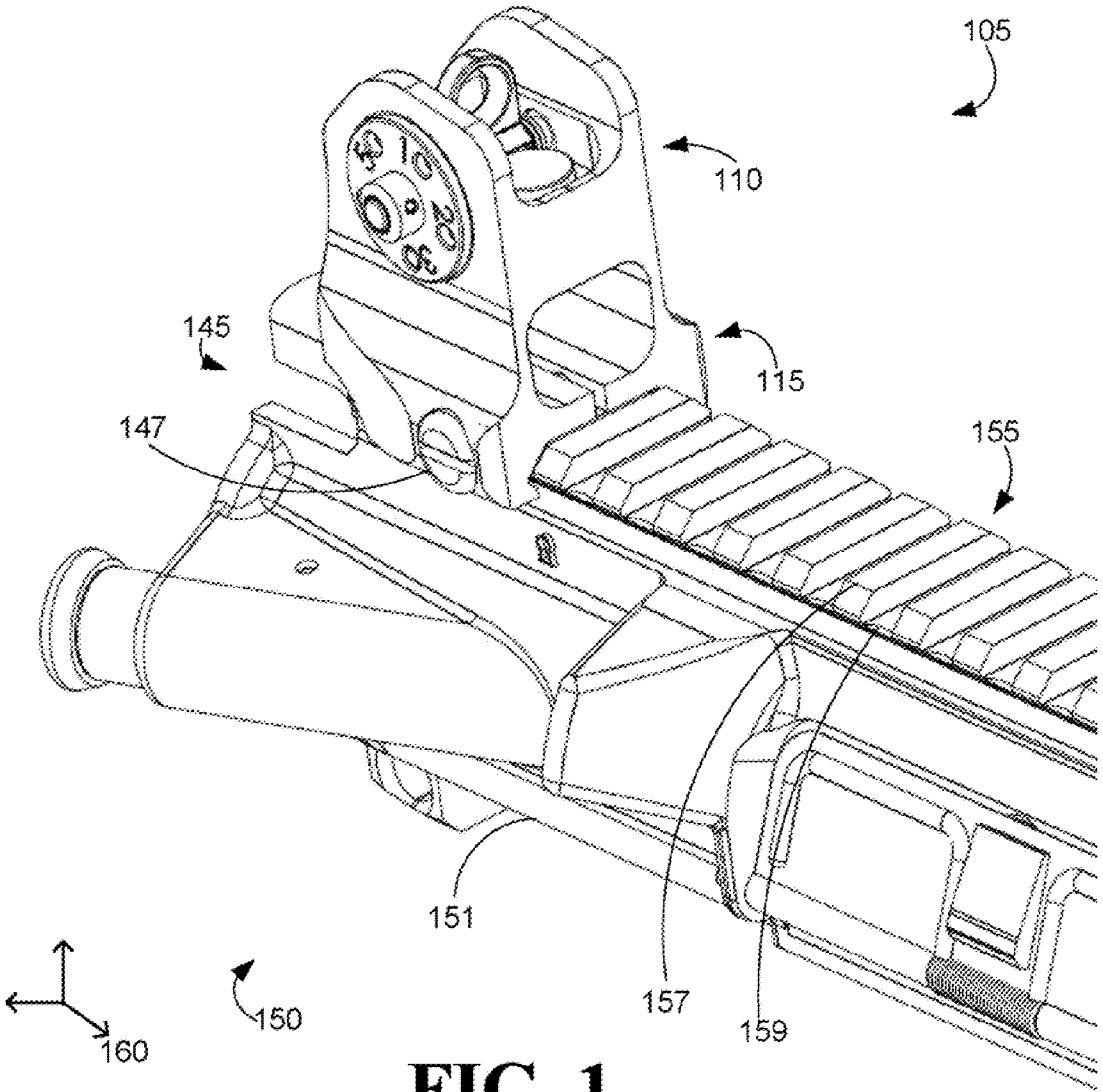
FIG. 1 is an example accessory associated with a firearm having a rail assembly according to one embodiment of the invention.

The invention now will be described more fully hereinafter with reference to the accompanying drawings, in which example embodiments of the invention are shown. This invention may however, be embodied in many different forms and should not be construed as limited to the example embodiments set forth herein; rather, these embodiments are provided so that this disclosure will convey the scope of the invention to those skilled in the art. Like numbers refer to like elements throughout.

Described below are embodiments of systems and methods for associating an accessory with a firearm, such as a firearm having a rail assembly. The systems and methods described can allow a user to position an accessory along the rail assembly of a firearm without sliding the accessory along the length of the rail assembly, although in certain embodiments a user may employ this option if desired. The accessory can include an accessory portion and an attachment portion for associating the accessory with the rail assembly when the accessory is snapped about the rail assembly. By allowing a user to snap the accessory about the rail assembly, certain embodiments of the invention can facilitate relatively quick attachment and release of the accessory from the firearm, such as by a user employing only one hand.

For example, a user who desires to maintain his or her operational posture may choose to employ one hand to longitudinally position the accessory along a firearm's rail assembly and to snap the accessory about the rail assembly, all while holding the firearm with his or her remaining hand in a way that maintains his or her operational posture. When snapping the accessory about the rail assembly, the user can hook the attachment portion about an exposed longitudinal edge of the rail assembly and rotate the accessory in relation to the rail assembly such that the attachment portion abuts an opposing longitudinal edge of the rail assembly. By pressing the accessory against the rail assembly, an expansion force can be created in the attachment portion that causes portions of the attachment portion to be displaced until the attachment portion is positioned about the opposing longitudinal edge of the rail assembly.

Once the accessory is snapped about the rail assembly, the user can free his or her hand from the accessory and use his or her free hand to secure the accessory to the rail, such as by clamping a portion of the accessory against the rail assembly, thereby limiting the movement of the accessory along the rail assembly. In some embodiments, the attachment portion can engage a portion of the rail assembly without the user separately securing the accessory to the rail assembly. For example, the attachment portion may include one or more ridges, or lugs, for residing within and/or engaging one or more grooves of the rail assembly. When the accessory is snapped about the rail assembly, the ridges can engage one or more grooves of the rail assembly to provide a relatively stable longitudinal association of the accessory with the firearm. In these ways, a user can relatively quickly secure an accessory to a firearm with one hand while still holding the firearm with the other hand in a way that maintains his or her operational posture. To quickly release the accessory from the firearm, a user can reverse the steps described above.

FIG. 1 illustrates an example rear sight accessory 105 associated with a firearm 150 having a rail assembly 155 according to one embodiment of the invention. The firearm 150 can comprise any firearm, including, but not limited to, an M-16 style rifle, an AR-15 style rifle, an AR-10 style rifle, or an M-4 style rifle, among others. Firearms like the firearm 150 generally include an upper receiver 151 and a barrel 153 and, in some embodiments, can further include a hand guard assembly (not pictured) positioned about the barrel 153. A hand guard assembly can include a rail assembly 155 for mounting one or more accessories. In the illustrated embodiment, the rail assembly 155 is illustrated as part of the upper receiver 151.

Rail assemblies provide a mounting platform for mounting one or more accessories to firearms. Rail assemblies usually conform to standards defined by a standards setting organization, like the U.S. government. One such rail assembly, known as the "Picatinny" rail assembly, is defined according to MIL-STD-1913. Another such rail assembly is known as a "Weaver" rail assembly and though similarly defined, differs from the Picatinny rail assembly in certain dimensions. In either case, the rail assemblies include a series of longitudinally spaced mounting projections 157 interleaved with a series of grooves 159. Each mounting projection 157 has a profile that includes a relatively flat middle portion and two triangular protuberances positioned on opposite sides of the middle portion. In the example embodiment, accessory 105 can be configured to quickly attach to a Picatinny rail assembly, but it will be understood that any type of rail assembly can be used.

The accessory 105 can include an accessory portion 110 and an attachment portion 115 configured to associate the accessory portion 110 with the firearm 150. The accessory portion 110 can include any accessory a user may desire to associate with the firearm 150. For example, in some embodiments, the accessory portion 110 can include a vertical fore grip for improving the user's grasp of the weapon. In other embodiments, the accessory portion 110 can include an optical sight, a laser device, a light, or a bipod for improving the user's visibility and/or accuracy when operating the firearm 150. In still other embodiments, the accessory portion 110 can include a bayonet or a grenade launcher and can be associated with improving the lethality of the firearm 150. In yet other embodiments, the accessory portion 110 can include a general purpose or special purpose adapter for mounting accessories to a firearm that may or may not be configured for mounting to the rail assembly 155. In the illustrated embodiments, an optical rear sight is shown as the accessory portion 110 of the accessory 105 in FIG. 1, FIG. 2, and FIG. 3. An optical front sight is shown as the accessory portion 410 of accessory 405 in FIG. 4. And a vertical fore grip is shown as the accessory portion 510 of accessory 505 in FIG. 5.

Figure 2:
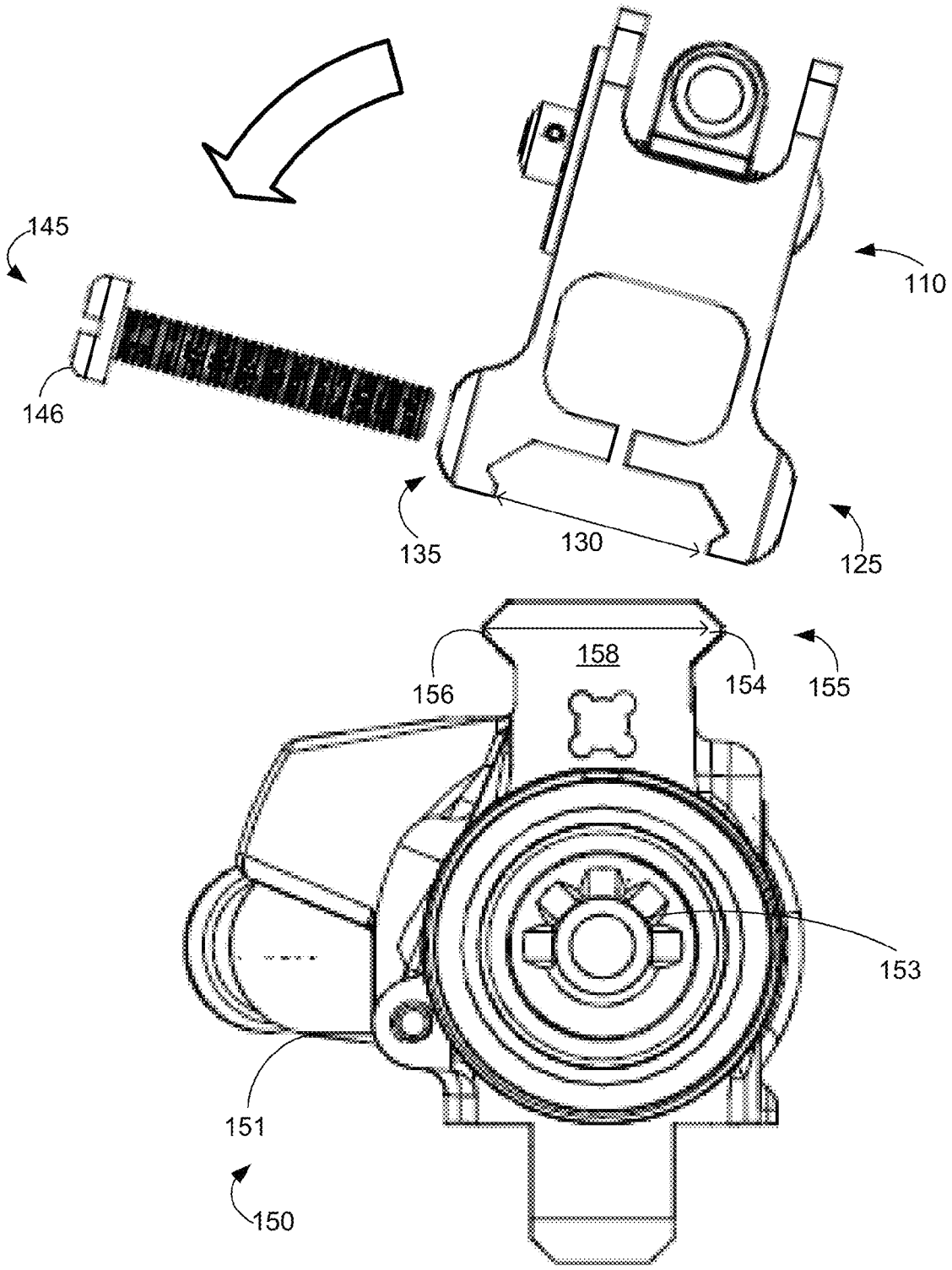
FIG. 2 is an example rear sight accessory having an accessory portion and an attachment portion illustrated in relation to certain dimensions of a firearm's rail assembly according to one embodiment of the invention.

As shown in FIG. 2, to associate the accessory 105 with the firearm 150, the attachment portion 115 can include one or more first mounting arms 125, one or more second mounting arms 135, and a securing mechanism 145. Once the accessory 105 is oriented in a desired spatial relation to the firearm 150, the first mounting arm 125 and the second mounting arm 135 can be configured to be positioned about a portion of the firearm 150 when the accessory 105 is snapped about the firearm 150. For example, in the example embodiment, the first mounting arm 125 and the second mounting arm 135 can be configured to be positioned and mounted about a portion the rail assembly 155 included on the upper receiver 151—such as one or more mounting projections 157—when the accessory 105 is snapped about the rail assembly 155. With the accessory 105 mounted about the rail assembly 155, the securing mechanism 145 can be configured to limit movement of the accessory 105 along one or more spatial directions associated with the rail assembly 155, such as along the length of the rail assembly 155 in a direction that is substantially parallel to the longitudinal axis 160.

In the example embodiment, snapping the accessory 105 about the rail assembly 155 can comprise positioning the first mounting arm 125 about one or more triangular protuberances 154 of the one or more mounting projections 157 such that a portion of the first mounting arm 125 is positioned about the one or more triangular protuberances 154. With the first mounting arm 125 so positioned, the accessory 105 can be rotated about the rail assembly 155, which could include rotating the accessory 105 about an axis that is substantially parallel to the longitudinal axis 160, until the second mounting arm 135 abuts an opposing triangular protuberance 156. As the second mounting arm 135 abuts the opposing triangular protuberance 156, the accessory 105 can be pressed against the rail assembly 155 until the second mounting arm 135 is displaced in relation to the first mounting arm 125 and positioned about the opposing triangular protuberance 156. In certain embodiments, this displacement can be associated with either or both of the first mounting arm 125 and the second mounting arm 135 flexing outward such that a portion of the rail assembly 155 is received between the first mounting arm 125 and the second mounting arm 135.

In certain embodiments of the invention, either or both of the first mounting arm 125 and the second mounting arm 135 can be manufactured from a relatively non-compliant material. A relatively non-compliant material can be any material that is relatively rigid and has a relatively narrow range of elasticity. Such a material can include aluminum, steel, nylon, plastic, a composite material, or the like to name a few. In embodiments where the mounting arms are manufactured from such a relatively non-compliant material, the mounting arms can exhibit features associated with a compliant material while also exhibiting features of the non-compliant material. For example, one such feature of a non-compliant material is the material's ability to provide a relatively rigid profile for mounting accessory 105, which can enable a relatively stable association of accessory 105 with the firearm 150. As opposed to a compliant material, such as those used in manufacturing certain covers for rail assembly 155, a non-compliant material can maintain a relatively stable mounting profile while sustaining the weight of accessory 105 and any forces applied to accessory 105 when in use. Were the mounting arms manufactured from a compliant material, the mounting arms would be too flexible to stably associate the accessory 105 in this way.

Figure 3:
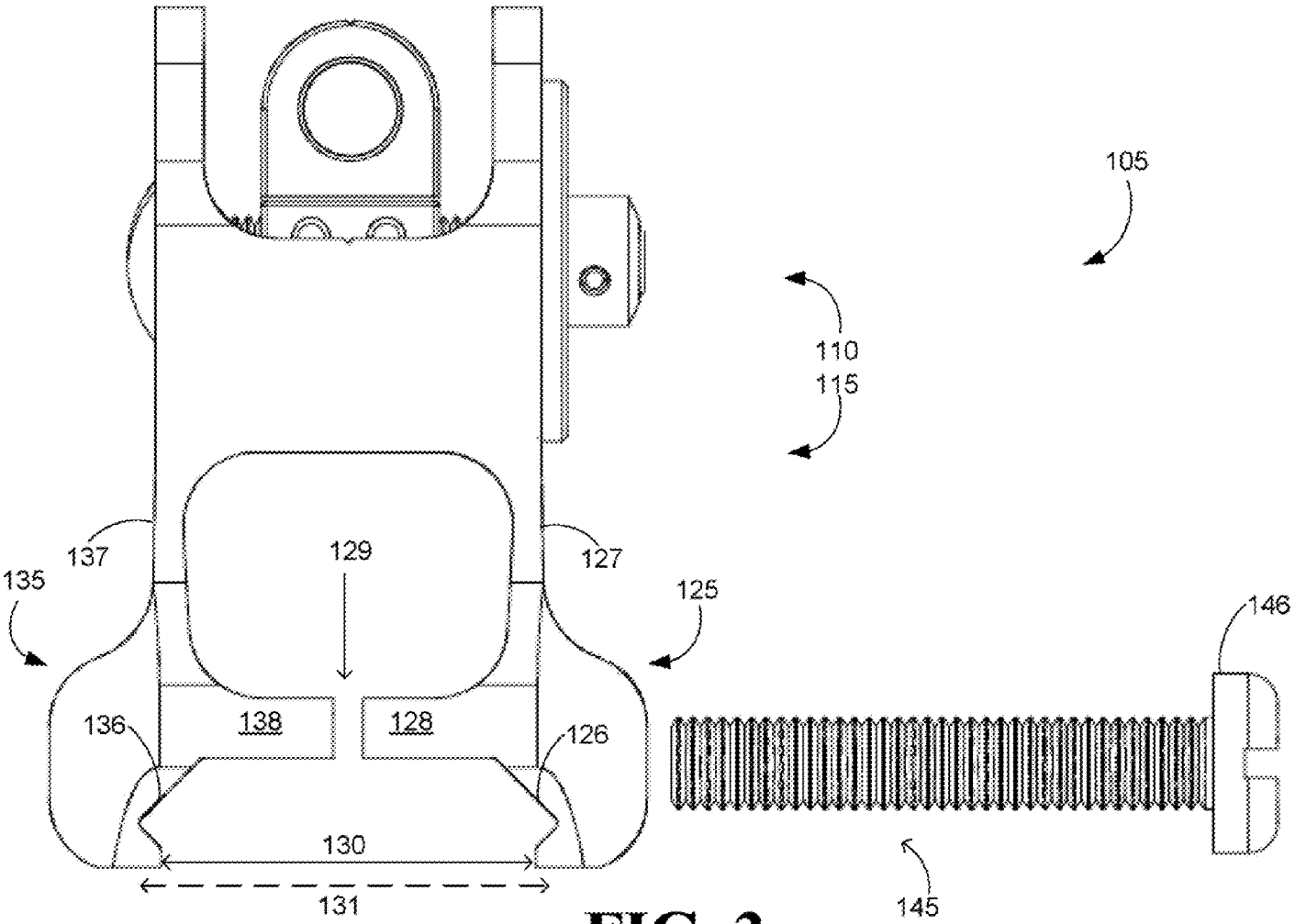
FIG. 3 is an example rear sight accessory having mounting arms and a securing mechanism according to one embodiment of the invention.

FIG. 3 illustrates a rear sight accessory 105 having example embodiments of a first mounting arm 125, a second mounting arm 135, and a securing mechanism 145 for mounting about a portion of the rail assembly 155. In the illustrated embodiment, the accessory portion 110 is positioned along upper ends of the first mounting arm 125 and the second mounting arm 135. A first dovetail channel 126 is positioned along a lower end of the first mounting arm 125, and a second dovetail channel 136 is positioned along a lower end of the second mounting arm 135. The first dovetail channel 126 and the second dovetail channel 136 are configured to mate with one or more dovetail projections of the rail assembly 155, such as the triangular protuberances 154 and 156 of the mounting projections 157.

The first dovetail channel 126 and the second dovetail channel 136 are configured to be spaced by a first distance 130 in a rest position, which can result when the accessory 105 is not associated with the rail assembly 155. The first dovetail channel 126 and the second dovetail channel 136 are also configured to be spaced apart by a second distance 131 in a displaced position, which can result from an expansion force that may result when the accessory 105 is snapped about the rail assembly 155. The first distance 130 corresponding to the rest position can be sized to be slightly smaller than a width 158 of the mounting projection 157 included as a part of the rail assembly 155. The second distance 131 corresponding to the displaced position can be sized to be slightly larger than the width 158 of the mounting projection 157.

In operation, the rest position, being sized smaller than the width 158, may prevent accessory 105 from being associated with the rail assembly 105 from a substantially transverse direction. When pivoted or laterally rocked about the rail assembly 155 and snapped thereto, however, the accessory 105 may be securely yet removably associated with the firearm 150. For instance, in a first motion, the accessory 105 can be positioned adjacent to the rail assembly 155 such that the first dovetail channel 126 of the first mounting arm 125 is adjacent to the triangular protuberance 154, which can also be referred to as the right dovetail projection 154 of the mounting projection 157. In a second motion, the accessory 105 can be pivoted, or laterally rocked, about the rail assembly 155, such as with the first dovetail channel 126 pivoting about the right dovetail projection 154 until the second dovetail channel 136 of the second mounting arm 135 becomes positioned in contact with an upper surface of the opposing triangular protuberance 156, which can also be referred to as the left dovetail projection 156. In a third motion, a downward force against the rail assembly 155 can be applied to the accessory 105, causing an expansion force to be imposed upon the second dovetail channel 136. With continued downward force, the second dovetail channel 136 can flex outward and travel away from the rail assembly 155. The angled shape of the left dovetail projection 156 can assist with this outward deflection. Once the second dovetail channel 136 passes the apex on the left dovetail ridge 156, the second dovetail channel 136 can return or flex inward at least partially as a result of the second mounting arm's 135 elastic properties. With continued downward motion, the second dovetail channel 136 can become firmly seated about the left dovetail projection 156 such that the mounting projection 157 of the rail assembly 155 is captured between the first dovetail channel 126 and the second dovetail channel 136.

It should be noted that directional terms are provided for the purposes of illustration and are not intended to limit the disclosure. Further, the directional terms generally describe the relative position of a component when the component is positioned on the firearm 150, and the firearm 150 is positioned in the intended orientation. For example, the terms "upper" or "upward" generally denote a direction above the firearm 150 when the firearm 150 is held in the intended orientation. The terms "lower" or "downward" generally denote a direction below the firearm 150 when the firearm 150 is held in the intended orientation. Similarly, the term "forward" generally denotes a direction facing away from the upper receiver 151 and facing toward the muzzle end of the firearm 150, while the term "rearward" generally denotes a direction facing away from the muzzle end of the firearm 150 and facing toward the upper receiver 151. Further, the terms "inner" or "inward" generally denote a direction that is toward the middle portion of the accessory 105, and the terms "outer" or "outward" generally denote a direction that is away from the middle portion of the accessory 105.

In one embodiment, to accommodate the outward deflection motion described above, the first mounting arm 125 can include a first connector arm 127, and the second mounting arm 135 can include a second connector arm 137. The first connector arm 127 can be positioned between the first dovetail channel 126 and the accessory portion 110, which can be positioned at an upper end of the first mounting arm 125. The second connector arm 137 can likewise be positioned between the second dovetail channel 136 and the accessory portion 110, which similarly can be positioned at an upper end of the second mounting arm 135. Either or both of the first connector arm 127 and the second connector arm 137 can be configured to flex outward in response to the expansion force that may result when either dovetail channel is pressed against a portion of the rail assembly 155. Either or both of the first connector arm 127 and the second connector arm 137 can also be configured, such as through a combination of structural design and/or the elastic properties of the materials employed, to flex inward when the expansion force decreases or is removed. For instance, the first connector arm 127 and the second connector arm 137 may comprise relatively thin structures that, though rigid, can also be temporarily deformable in response to certain forces exerted upon them. When these forces are removed, the structural aspects of the first connector arm 127 and the second connector arm 137 may enable the connector arms to return to their non-deformed positions.

In addition to the first mounting arm 125 and the second mounting arm 135, the attachment portion 115 can include a securing mechanism 145 for limiting movement of the accessory 105 along one or more spatial directions associated with the rail assembly 155. One such spatial direction can include a direction that is substantially parallel to the longitudinal axis 160 of the rail assembly 155, such as along the length of the rail assembly 155. To limit movement of the accessory 105 in this longitudinal direction, securing mechanism 145 can be configured to apply a clamping force against the rail assembly 155 and/or to engage at least one groove 159 of the rail assembly 155.

For example, the securing mechanism 145 may be configured to include a fastener 146. The fastener 146 may be any suitable fastener including, but not limited to, a thumb screw or a pan head screw. One or more of the mounting arms can be modified to receive the fastener 146 such that through appropriate manipulation of the fastener 146, the mounting arms can be pulled inward to exert a clamping force against the rail assembly 155. In one embodiment, the mounting arms can include a passage for receiving the fastener 146. In some embodiments, either or all of the passages in the mounting arms may be threaded. In other embodiments, the fastener 146 can be positioned to engage a groove 159 of the rail assembly 155, such as by residing within the groove 159, when being received by the passages in the mounting arms. Engaging a groove 159 of the rail assembly 155 is but one additional way to limit movement of the accessory 105 along one or more spatial directions associated with the rail assembly 155.

In certain embodiments of the invention, the attachment portion 155 can be further configured to limit the movement of the first mounting arm 125 and the second mounting arm 135 in an inward direction. Such a configuration may be desirable since, in clamping the first mounting arm 125 and the second mounting arm 135 in an inward direction against the rail assembly 155, some embodiments of the securing mechanism 145 can exert deformation forces in the mounting arms. To limit the amount of deformation, which may be desirable to ensure the mounting arms do not deform in an amount that exceeds their elastic limits, the attachment portion 115 can be employed.

For example, the attachment portion 115 of accessory 105 can be modified to include a first inwardly projecting member 128 and a second inwardly projecting member 138. The first inwardly projecting member 128 can be included as a part of the first mounting arm 125 and in the example embodiment projects inwardly toward the second mounting arm 135 at a substantially perpendicular angle from the first mounting arm 125. The second inwardly projecting member 138 can be similarly oriented in relation to the second mounting arm 135. The first inwardly projecting member 128 and the second inwardly projecting member 138 can be disposed opposing one another and separated by a distance 129. The distance 129 can be established with relation to the elastic properties of the first mounting arm 125 and the second mounting arm 135. As the first mounting arm 125 and the second mounting arm 135 are pulled inward by the securing mechanism 145, the distance 129 shrinks until the first inwardly projecting member 128 and the second inwardly projecting member 138 contact one another. At this point, the inwardly projecting members exert an outward force substantially equal to and in opposition to the inward force created by the securing mechanism 145. This outward force can prevent further deformation of the first mounting arm 125 and the second mounting arm 135 by the securing mechanism 145. In at least this way, the first inwardly projecting member 128 and the second inwardly projecting member 138 can be spatially oriented in relation to one another to limit the inward movement of the first mounting arm 125 and the second mounting arm 135. In other embodiments of the invention, other spatial orientations and other configurations of the attachment portion 115 are possible.

Figure 4:
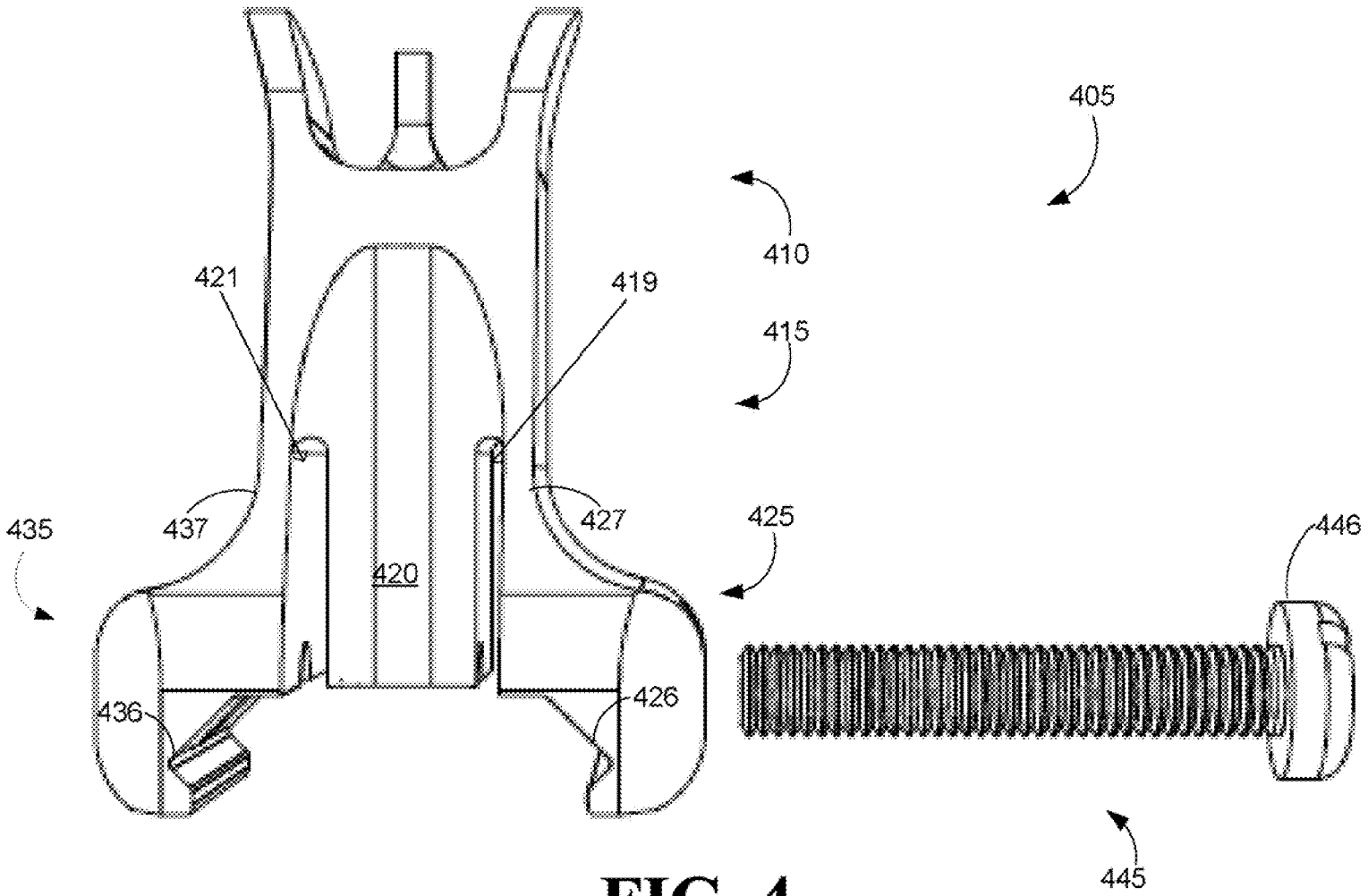
FIG. 4 is an example front sight accessory having an attachment portion configured to limit the inward movement of the mounting arms according to one embodiment of the invention.

FIG. 4 illustrates one such configuration of an attachment portion 415 for a front sight accessory 405. The front sight accessory 405 includes an accessory portion 410 and an attachment portion 415 having a first mounting arm 425, a second mounting arm 435, and a securing mechanism 445. The front sight accessory 405 also includes a first dovetail channel 426 positioned along a lower end of a first mounting arm 425 having a first connector arm 427. The first connector arm 427 is disposed between the first dovetail channel 426 and the accessory portion 405. Also included is a second dovetail channel 436 positioned along a lower end of the second mounting arm 435. The second mounting arm 435 includes a second connector arm 437 positioned between the second dovetail channel 436 and the accessory portion 405.

The first dovetail channel 426 and the second dovetail channel 436 can be configured to receive the threaded fastener 446 of securing mechanism 445 such that the threaded fastener 446, through appropriate manipulation, pulls the first mounting arm 425 and the second mounting arm 435 inward to clamp against a portion of a rail assembly. In so doing, deformation forces can be sustained in the first connector arm 427 and the second connector arm 437. To limit these deformation forces, a pillar 420 can be disposed between the first connector arm 426 and the second connector arm 436. The pillar 420 can extend downward from a lower end of the accessory portion 410 and can be separated from the first connector arm 427 by a distance 419, which can be defined as a distance between a lateral face of the pillar 420 and an opposing lateral face of the first connector arm 427. Similarly, the pillar 420 can be separated from the second connector arm 437 by a distance 421, which can be defined as a distance between a lateral face of the pillar 420 and an opposing lateral face of the second connector arm 437.

As the first mounting arm 425 and the second mounting arm 435 are pulled inward, their deformation will result in the distance 419 being reduced until the lateral face of the first connector arm 427 contacts the opposing lateral face of the pillar 420. The distance 421 will similarly be reduced in relation to the second connector arm 437. In both instances, the pillar 420 can exert an opposing outward force against the mounting arms that is substantially equal to the inward forces created by the securing mechanism 445 that cause the associated inward deformation of the mounting arms.

In some embodiments, pillar 420 can be included as a part of the securing mechanism 445 and configured to limit movement of the accessory 405 along the firearm in one or more spatial directions. For example, in one embodiment, the pillar 420 can be configured to engage a portion of a rail assembly, such as the grooves 159 of the rail assembly 155 shown in FIG. 1. Such an embodiment is illustrated in FIG. 5A and FIG. 5B.

Figure 5B:
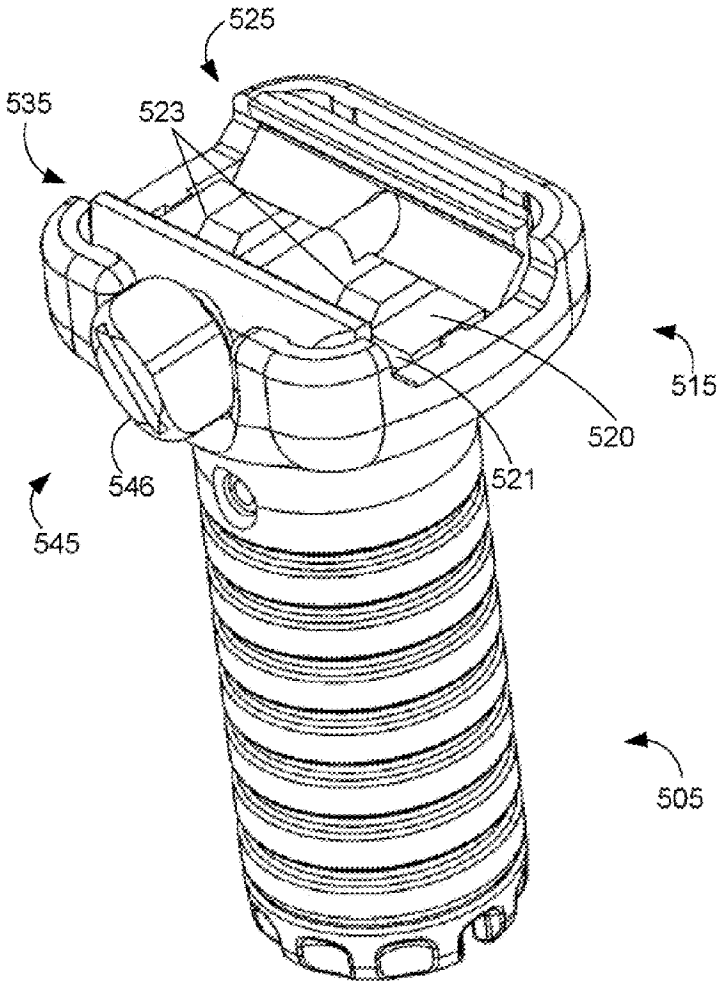
FIG. 5A-5B illustrate an example vertical fore grip having separate accessory and attachment portions, and wherein the attachment portion is configured to limit the inward movement of the mounting arms and is further configured to engage multiple grooves of the rail assembly according to one embodiment of the invention.
Figure 5A:
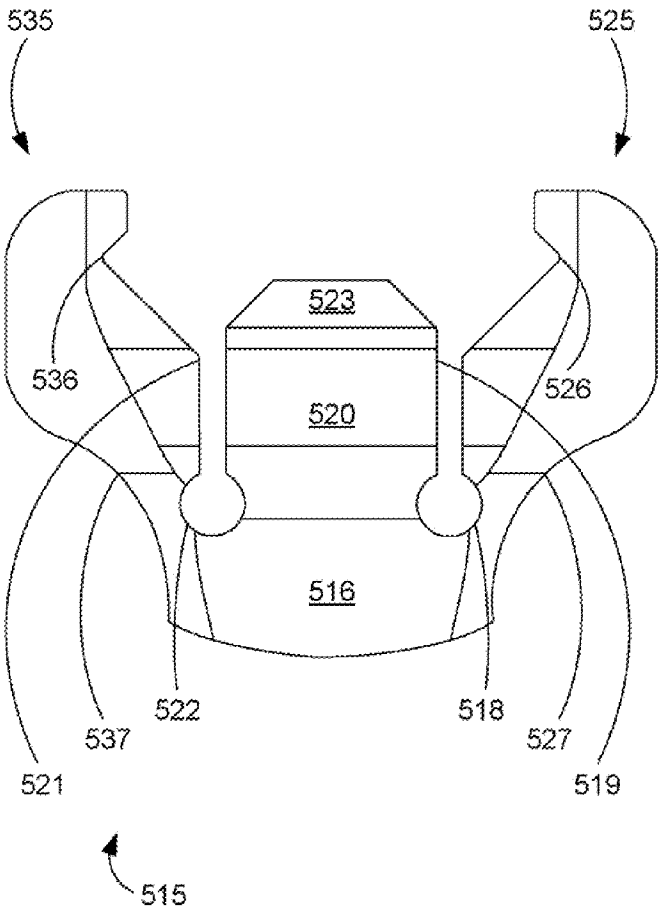

FIG. 5A and FIG. 5B illustrate an example vertical fore grip accessory 505. Unlike the example rear sight accessory 105 and the example front sight accessory 405, the example vertical fore grip accessory 505 includes an accessory portion 510 and an attachment portion 515 that are not integrated into as a single component. Rather, the accessory portion 510 and attachment portion 515, which is shown in FIG. 5A, are provided as separate components that can be physical combined through one or more attachment mechanisms to form the vertical fore grip accessory 505 shown in FIG. 5B.

Attachment portion 515 can include a first mounting arm 525 and a second mounting arm 535. The first mounting arm 525 can include a first dovetail channel 526 disposed on an upper end of the first mounting arm 525, and a first connector arm 527 disposed on a lower end of the first mounting arm 525. The second mounting arm 535 similarly can include a second dovetail channel 536 disposed on an upper end of the second mounting arm 535, and a second connector arm 537 disposed on a lower end of the second mounting arm 535. Also included can be a pillar 520 disposed between the first mounting arm 525 and the second mounting arm 535.

The pillar 520 can project upward from a base 516 located at a lower end of the attachment portion 515. Pillar 520 can be separated by a channel 519 from the first mounting arm 527. The distance between the pillar 520 and the first mounting arm 527, which corresponds to the width of the channel 519, can be defined as the distance between a lateral face of the pillar 520 and an opposing lateral face of the first mounting arm 525. The channel 519 can include a bulbous-like groove 518 at a lower end of the channel 519, which may support certain flexing properties of the first mounting arm 525. Pillar 520 can be similarly separated from the second mounting arm 535 by a channel 521, which likewise can include a bulbous-like groove 522.

In the example embodiment of the vertical fore grip accessory 505, the pillar 520 can be part of the securing mechanism 545. The securing mechanism 545 can be configured to limit movement of the vertical fore grip accessory 505 along one or more spatial directions associated with a rail assembly, like the rail assembly 155 shown in FIG. 1. For example, the securing mechanism 545 is shown as including a thumb screw 546 for engaging the first mounting arm 525 and the second mounting arm 535 to pull the mounting arms inward such that a clamping force can be exerting against the rail assembly. The clamping force exerted by the first mounting arm 525 and the second mounting arm 535 can be associated with limiting the movement of the vertical fore grip accessory 505 along the length of the rail assembly when mounted to the rail assembly.

To supplement this clamping force, or in some embodiments to replace it, pillar 520 can be configured to include one or more ridges 523, or lugs, for engaging one of more grooves of the rail assembly, such as the grooves 159 in the rail assembly 155. In the example embodiment, two ridges 523 are provided for engaging two corresponding grooves in the rail assembly when the vertical fore grip accessory 505 is snapped about the rail assembly. The ridges 523, by residing within the grooves, can limit movement of the vertical fore grip accessory 505 along the length of the rail assembly. That is, since the ridges 523 will abut against a lateral face of the groove when residing in the groove, when the vertical fore grip accessory 505 is moved in a longitudinal direction, the physical contact between the ridges 523 and the lateral face of the groove will limit further longitudinal displacement of the vertical fore grip accessory 505 along the rail assembly.

In some embodiments, the ridges 523 can be sized to provide a relatively loose longitudinal association of the vertical fore grip accessory 505 with the rail assembly. In some embodiments, the ridges 523 can be sized to provide a relatively tight longitudinal association of the vertical fore grip accessory 505 with the rail assembly. In other embodiments, the ridges 523 may include one or more mechanisms for snapping into one or more grooves of the rail assembly such that the ridges 523 provide multiple associations of the vertical fore grip accessory 505 with the rail assembly. Other configurations are also possible.

Figure 6:
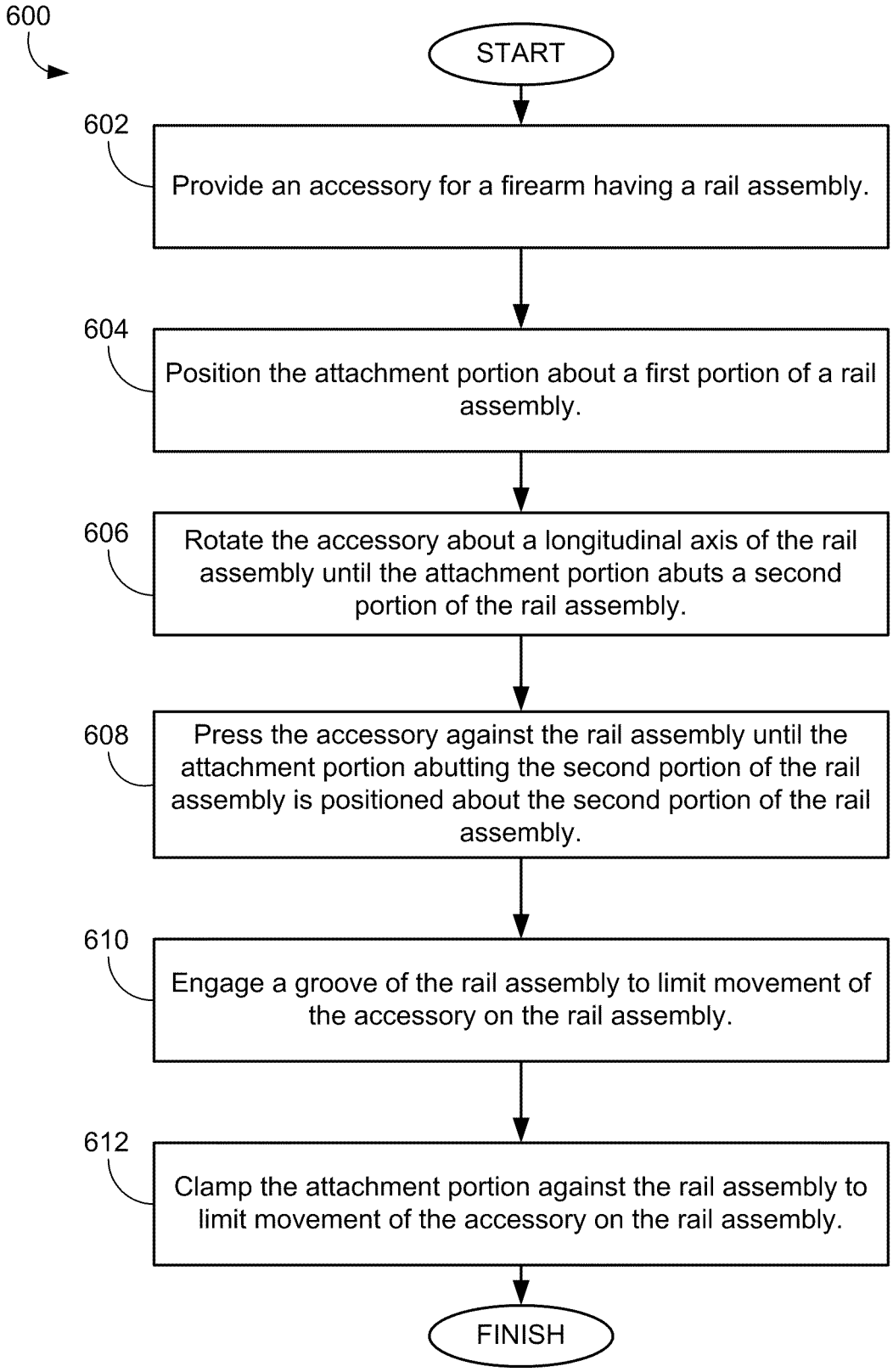
FIG. 6 is an example method for associating an accessory with a firearm according to one embodiment of the invention.

FIG. 6 illustrates an example method 600 for associating an accessory with a firearm. The firearm can include any suitable firearm, such as an M-16 style rifle, an AR-15 style rifle, an AR-10 style rifle, an M-4 style rifle, or the like. Affixed to the firearm can be a rail assembly, such as the Picatinny rail or the Weaver rail. The method can begin at block 602 where the aforementioned accessory for the firearm can be provided. The accessory can comprise an accessory portion and an attachment portion having one or more first mounting arms, one or more second mounting arms, and a securing mechanism. The accessory portion can include any suitable accessory for a firearm, such as, but not limited to, a bayonet, a bipod, a vertical fore grip, an optical sight, a laser, a light, or an adapter to name a few. In some embodiments, the accessory portion and the attachment portion can be wholly or partially integrated into a single component. In other embodiments, the accessory portion and the attachment portion can be provided as separate components.

At block 604, the attachment portion can be positioned about a first portion of the rail assembly on the firearm. For example, in one embodiment the attachment portion may comprise a first mounting arm adapted to be positioned about a triangular protuberance of a mounting projection on the rail assembly. With the first mounting arm so positioned, the method 600 can continue at block 606 where the accessory can be rotated about a longitudinal axis of the rail assembly until the attachment portion abuts a second portion of the rail assembly. For example, in one embodiment, the attachment portion can include a second mounting arm. With the first mounting arm positioned about a triangular protuberance of the mounting projection, the accessory can be rotated about the rail assembly in a direction such that the second mounting arm abuts a triangular protuberance positioned on the opposite side of the mounting projection.

At block 608, the accessory can be pressed against the rail assembly until the attachment portion abutting the second portion of the rail assembly is positioned about the second portion of the rail assembly. In one embodiment, pressing the accessory against the rail assembly can include pressing the accessory against the rail assembly from a direction that is substantially transverse to a longitudinal axis of the rail assembly. In embodiments including a first mounting arm and a second mounting arm, positioning the attachment portion about the second portion of the rail assembly can include pressing the accessory against the rail assembly until the second mounting arm flexes outward so that a portion of the rail assembly can be received between the first mounting arm and the second mounting arm. In other embodiments including a first mounting arm and a second mounting arm, the first mounting arm may be configured to flex outward while in other embodiments, both the first mounting arm and the second mounting arm can be configured to flex outward.

At block 610, the accessory can engage a groove of the rail assembly to limit movement of the accessory on the firearm. For example, in some embodiments, the accessory can be configured to include one or more ridges or lugs for residing within one or more grooves of the rail assembly to limit movement of the accessory along the length of the rail assembly. In other embodiments, a fastener used to engage a portion of the accessory can be configured to engage one or more grooves of the rail assembly.

At block 612, the attachment portion of the accessory can be clamped against the rail assembly to further limit movement of the accessory on the rail assembly. In some embodiments, clamping the attachment portion of the accessory against the rail assembly may include clamping a first mounting arm and a second mounting arm inward and against a portion of the rail assembly. In some embodiments, clamping may include engaging the first mounting arm and the second mounting arm with a fastener. Other configurations are also possible.

After block 612, the method 600 ends. When employed, method 600 can enable an appropriate accessory to be securely associated with a firearm without having to slide the accessory along the length of the firearm, such as along the length of a rail assembly included as part of the firearm. In addition, because the accessory can be snapped about a portion of the firearm, the accessory can be relatively quickly mounted to and dismounted from the firearm, such as through a rail assembly, by a user who may choose to employ only one hand.

It will be understood that spatial terms used herein, such as "upper" and "lower", and relative terms, such as "above" and "below", are used to facilitate understanding of the disclosure. Such terms are not intended to be limiting. For example, a person of skill will understand that a rail assembly may have mounting projections located on any side of the rail, and that an accessory can be associated with a rail assembly in any orientation.

Furthermore, while particular embodiments of the invention have been disclosed in detail as part of the foregoing description and figures, they are described for purposes of example. Those skilled in the art will understand that variations and modifications may be made without departing from the scope of the disclosure. All such variations and modifications are intended to be included within the scope of the present disclosure, as protected by the following claims.

The claimed invention is:

1. An accessory for a firearm comprising:

an accessory portion; and an attachment portion that associates the accessory portion with a portion of a rail assembly when the attachment portion is snapped about the rail assembly, the attachment portion comprising:

at least one first mounting arm and at least one second mounting arm, wherein the at least one first and second mounting arms are positioned about the portion of the rail assembly when snapped about the portion of the rail assembly, and wherein the accessory portion is positioned along an upper end of the at least one first and second mounting arms;

a dovetail channel positioned along a lower end of each of the at least one first and second mounting arms that mates with a dovetail projection of the rail assembly, the dovetail channel comprising a rest position when the accessory is not associated with the rail assembly and comprising a displaced position when either dovetail channel is pushed against at least a portion of the rail assembly;

a connecting arm positioned between the dovetail channel and the accessory portion that flexes outward in response to an expansion force imposed upon the dovetail channel when the dovetail channel is pushed against a portion of the rail assembly; and a securing mechanism comprising a non-securing position and a securing position, the securing position comprising a pulling force exerted on the at least one first and second mounting arms creating an increased clamping force against the portion of the rail assembly when the at least one first and second mounting arms are snapped about the rail assembly.

2. The accessory of claim 1, wherein the accessory portion comprises at least one of the following: a bayonet, a bipod, a vertical fore grip, an optical sight, a laser, a light, or an adapter.

3. The accessory of claim 1, wherein the rail assembly comprises at least one of the following: a Picatinny rail or a Weaver rail.

4. The accessory of claim 1, wherein the at least one first and second mounting arms comprise at least one of the following materials: aluminum, steel, nylon, plastic, or a composite material.

5. The accessory of claim 1, wherein the securing mechanism engages at least one groove of the rail assembly to limit movement of the accessory in relation to the rail assembly in at least a substantially longitudinal direction.

6. The accessory of claim 1, wherein the securing mechanism comprises at least one fastener that clamps the at least one first and second mounting arms against at least a portion of the rail assembly.

7. The accessory of claim 6, wherein the fastener engages at least one groove of the rail assembly.

8. The accessory of claim 1, wherein the attachment portion limits movement of the at least one first and second mounting arms in an inward direction when the at least one first and second mounting arms are clamped against a portion of the rail assembly.

9. The accessory of claim 1, wherein the at least one first and second mounting arms further comprise at least one inwardly projecting member, the at least one inwardly projecting member of the at least one first mounting arm being spatially oriented in relation to the at least one inwardly projecting member of the at least one second mounting arm to limit movement of the at least one first and second mounting arms in an inward direction.

10. The accessory of claim 1, further comprising at least one lug that engages at least one groove of the rail assembly to limit movement of the accessory in relation to the rail assembly in at least a substantially longitudinal direction.

11. A system for associating an accessory with a firearm, the system comprising:

at least one first mounting arm and at least one second mounting arm, wherein the at least one first and second mounting arms are spaced apart to be position about a portion of a rail assembly when the at least one first and second mounting arms are snapped about the rail assembly, and wherein an accessory portion is positioned along an upper end of the at least one first and second mounting arms;

a dovetail channel positioned along a lower end of each of the at least one first and second mounting arms that mates with a dovetail projection of the rail assembly, the dovetail channel comprising a rest position when not associated with the rail assembly and comprising a displaced position when either dovetail channel is pushed against at least a portion of the rail assembly;

a connecting arm positioned between the dovetail channel and the accessory portion that flexes outward in response to an expansion force imposed upon the dovetail channel when the dovetail channel is pushed against a portion of the rail assembly; and a securing mechanism comprising a non-securing position and a securing position, the securing position comprising a pulling force exerted on the at least one first and second mounting arms creating an increased clamping force against the portion of the rail assembly when the at least one first and second mounting arms are snapped about the rail assembly.

12. The system of claim 11, wherein the rail assembly comprises at least one of the following: a Picatinny rail or a Weaver rail.

13. The system of claim 11, wherein the securing mechanism comprises at least one fastener that clamps the at least one first and second mounting arms against at least a portion of the rail assembly.

14. The system of claim 11, wherein the securing mechanism engages at least one groove of the rail assembly to limit movement of the accessory in relation to the rail assembly in at least a substantially longitudinal direction.

15. The system of claim 11, wherein the at least one first and second mounting arms further comprise at least one inwardly projecting member, the at least one inwardly projecting member of the at least one first mounting arm being spatially oriented in relation to the at least one inwardly projecting member of the at least one second mounting arm to limit movement of the at least one first and second mounting arms in an inward direction.

16. The system of claim 11, further comprising at least one lug that engages at least one groove of the rail assembly to limit movement in relation to the rail assembly in at least a substantially longitudinal direction.

* * * * *